US005881816A

United States Patent [19]

Wright

[11] Patent Number: 5,881,816

[45] Date of Patent: Mar. 16, 1999

[54] PACKER MILL

[75] Inventor: Ralph D. Wright, Aberdeen, Scotland

[73] Assignee: Weatherford/Lamb, Inc., Houston, Tex.

[21] Appl. No.: 834,003

[22] Filed: Apr. 11, 1997

[51] Int. Cl.[6] ..... E21B 33/10

[52] U.S. Cl. ..... 166/376; 166/55.7; 294/86.34

[58] Field of Search ..... 166/376, 298, 166/301, 55.1, 55.6, 55.7, 240; 294/86.34, 86.13, 86.17, 86.12, 86.33

[56] References Cited

U.S. PATENT DOCUMENTS

| | | | |
|---|---|---|---|
| 1,583,767 | 5/1926 | Akins et al. . | |
| 1,638,494 | 8/1927 | Lewis et al. . | |
| 2,762,438 | 9/1956 | Naylowr | 166/103 |
| 2,804,151 | 8/1957 | LeBus, Sr. . | |
| 2,880,804 | 4/1959 | Fredd | 166/55.8 |
| 2,893,491 | 7/1959 | Crowe | 166/103 |
| 2,904,114 | 9/1959 | Webb et al. | 166/103 |
| 2,921,630 | 1/1960 | LeBus et al. | 175/80 |
| 3,082,831 | 3/1963 | LeBus, Sr. | 294/86.34 |
| 3,095,926 | 7/1963 | Rush | 294/86.34 |
| 3,500,909 | 3/1970 | Beyer | 166/240 |
| 3,747,674 | 7/1973 | Murray | 166/98 |
| 3,983,936 | 10/1976 | Kennard et al. | 166/5 |
| 4,047,568 | 9/1977 | Aulenbacher | 166/298 |
| 4,099,561 | 7/1978 | Nelson | 166/55.1 |
| 4,191,255 | 3/1980 | Rives | 166/297 |
| 4,273,464 | 6/1981 | Scott | 403/348 |
| 4,321,965 | 3/1982 | Restarick | 166/177.5 |
| 4,397,355 | 8/1983 | McLamore | 166/297 |
| 4,420,049 | 12/1983 | Holbert | 175/45 |
| 4,616,721 | 10/1986 | Furse | 175/320 |
| 4,765,404 | 8/1988 | Bailey et al. | 166/1 |
| 5,035,292 | 7/1991 | Bailey et al. | 175/45 |
| 5,040,598 | 8/1991 | Pleasants | 166/98 |
| 5,074,361 | 12/1991 | Brisco et al. | 166/301 |
| 5,086,852 | 2/1992 | vanBuskirk | 175/269 |
| 5,123,489 | 6/1992 | Davis et al. | 294/86.34 |

(List continued on next page.)

FOREIGN PATENT DOCUMENTS

| | | |
|---|---|---|
| 83300384 | 10/1983 | European Pat. Off. . |
| 0 802 304 A1 | 4/1996 | European Pat. Off. . |

OTHER PUBLICATIONS

Slim Hole and Coiled Tubing Window Cutting Systems, Faure et al, SPE, 1993.

Horizontal Slim–Hole Drilling With Coiled Tubing: An Operator's Experience, Ramos, SPE, 1992.

Int'l Search Report, PCT–GB98–01068—Foreign Counterpart of This Case Aug. 1998.

*Primary Examiner*—William Neuder
*Attorney, Agent, or Firm*—Guy McClung

[57] ABSTRACT

A packer mill system for milling a packer in a wellbore has been invented which has, in certain aspects, a bushing with a hollow generally cylindrically shaped bushing body with a bottom, a top, a bushing bore extending therethrough from top to bottom, and at least one key on an interior surface thereof, the at least one key projecting inwardly into the bushing bore, a mandrel initially disposable within the bushing, the mandrel having a hollow generally cylindrically shaped mandrel body with a top, a bottom, a mandrel bore extending therethrough from top to bottom, and a slot system formed in an exterior surface of the mandrel body, the at least one key disposed for movement through the slot system, engagement apparatus connected to the bottom of the mandrel body for engaging the packer, milling apparatus connected to the bottom of the bushing body and disposed for movement therethrough of the engagement apparatus, the slot system having a series of one or more interconnected slots through which the at least one key is movable, the series of interconnected slot(s) including one or more exits at the top and at the bottom for movement of the at least one key out from the slot system thereby freeing the bushing from the mandrel. In certain aspects torsion or torque is applied only by the slot system and only in a single direction so that, when using a downhole motor, a rotary shoe or other mill can be replaced or redressed and then reinserted into the wellbore through the slot system to continue milling.

22 Claims, 3 Drawing Sheets

U.S. PATENT DOCUMENTS

| | | | |
|---|---|---|---|
| 5,154,231 | 10/1992 | Bailey et al. | 166/298 |
| 5,228,507 | 7/1993 | Obrejano et al. | 166/98 |
| 5,310,001 | 5/1994 | Burns, Sr. et al. | 166/301 |
| 5,318,115 | 6/1994 | Rouse | 166/55.7 |
| 5,335,737 | 8/1994 | Baugh | 175/61 |
| 5,361,834 | 11/1994 | Cox | 166/120 |
| 5,398,754 | 3/1995 | Dinhoble | 166/117.6 |
| 5,411,107 | 5/1995 | Hailey et al. | 175/296 |
| 5,427,179 | 6/1995 | Bailey et al. | 166/117.6 |
| 5,437,340 | 8/1995 | Lee et al. | 175/61 |
| 5,484,021 | 1/1996 | Hailey | 166/297 |
| 5,499,680 | 3/1996 | Walter et al. | 166/377 |
| 5,580,114 | 12/1996 | Palmer | 294/86.15 |

PACKER MILL

BACKGROUND OF THE INVENTION

1. Field of the Invention

This invention is directed to wellbore retrieval mechanisms, wellbore packer mills, and to a selective indexing mechanism for wellbore tools.

2. Description of Related Art

The prior art discloses a variety of wellbore packers for installation in the casing of an oil well for isolating upper and lower sections of the casing. A single completion packer has a central bore and surrounding structure that seals the packer inside the casing. Tubing can be connected to or through the packer for withdrawing fluids from the well.

Certain releasable prior art packers release and are readily removable from the casing. Other packers are more or less permanently fixed in the casing. With the readily removable packers corrosion or damage often prevents removal. It is common in oil well operations to mill a packer to remove it from the well. This destroys the packer and milling chips are pumped out of the well or are caught in downhole debris collectors. A magnet removes junk in the well or the junk is milled by a common junk mill. Often the remains of the packer and any tubing or other items hanging from it are freed from the casing and fall free. These things are caught by a grip or catcher on the milling tool and they are moved up and removed from the wellbore.

The remains of the packer often become stuck in the wellbore. The milling tool may become worn or damaged before the packer is free. Thus it may be desirable to remove the milling tool while leaving the remainder of the packer in the well. To do this releasing apparatus is provided on the packer so the mill can then be withdrawn and the well reentered with the same or a different tool for completing removal of the packer.

Known packer mill release apparatuses have slots so the packer mill is releasable by lowering and reversing the direction of rotation. These apparatuses have a multiplicity of moving parts and therefore such mechanisms often jam and the operator must fish the remains of the packer mill as well as the packer, or mill all the junk in the well.

Other prior art apparatuses have pins, screws or stops that shear when a large lifting force is applied to the packer mill so the junk catcher is released and the packer mill can be withdrawn. Use of this apparatus can produce unwanted loose parts such as the ends of pins which require removal from the well. Such loose parts themselves can cause jamming. Deformation of the holes in which such items are inserted may be caused by shear pins and bolts and result in difficulties in reusing the packer mill assembly. This damage may not be readily repaired in the field causing additional delay.

U.S. Pat. No. 4,616,721 discloses a milling tool for removing a packer from a well which includes a releasable catcher for supporting remains of a milled packer. The catcher has a sleeve with deflectable fingers which normally support the remains of the packer. If the packer becomes stuck, the fingers press on a release ring which has a ramp that engages a complementary ramp on a shoulder on the mandrel of the mill. The ramps cam the ring outwardly until the ring breaks in tension at a deliberately weakened location. This releases the sleeve to slide downwardly and permit the fingers to deflect inwardly into a recess thereby clearing the bore of the stuck packer. A retrieval portion of this tool is permanently attached to the milling tool. This retrieval portion must rotate below the packer as the packer is being milled.

U.S. Pat. No. 5,310,001 discloses an apparatus for retrieving downhole devices which includes a retrieving device that can be run on non-conventional work strings such as coiled tubing, wireline, or electric line. The apparatus has a power mandrel, an inner sleeve mandrel slidably disposed within the power mandrel, and an overshot means. Means are provided to translate longitudinal movement of the power mandrel into rotational movement of the inner mandrel. This apparatus does not employ milling to remove a packer and no portion of the equipment may be removed if its latch mechanism is engaged with a packer.

There has long been a need for an efficient and effective packer mill. There has long been a need, recognized by the present inventors, for such a packer mill with a milling device, e.g. a rotary shoe, that can be selectively replaced while leaving other portions of the apparatus, e.g. a spear, in engagement with the packer. The present inventors have also recognized a long felt need for such a packer mill which can be used with a downhole motor or mud motor.

SUMMARY OF THE PRESENT INVENTION

The present invention, in one aspect, discloses a packer mill assembly with an outer hollow cylindrical tubular bushing member within which is releasably mounted a hollow tubular mandrel. In one aspect the mandrel is shear pinned to the bushing with one or more shear pins set to shear in response to a force, e.g., one, two, or more pins are used that shear at 10,000 pounds of force. One or more keys projecting inwardly from an interior surface of the bushing are sized and disposed for movement in and with respect to a slot system on an exterior surface of the mandrel once the shear pins have been sheared. A milling apparatus, e.g. but not limited to a common rotary shoe, is releasably connected to a bottom end of the bushing. Alternatively, the slot system may be on the interior surface of the bushing and the key(s) may project from the exterior surface of the mandrel into the slot system.

In one aspect the slot system has a multi-branched slot or slots in which the key or keys are movable. Also, the slot system has one or more exit channels at the top of the slot system so that the bushing (and attached milling apparatus) are selectively releasable from the mandrel. This can be done at any desired time, including but not limited to when the spear is engaged with a packer to be milled or the rotary shoe requires replacement. Thus the milling apparatus can be raised from the wellbore and re-dressed or replaced for re-insertion, re-engagement of the mandrel, and additional milling. Sub slots of the slot system are configured and disposed so that using only up-down motion of a work string the slot system itself "torques" the string or moves it laterally (torsionally) so that no torque need be applied to the work string itself by other means to accomplish slot system traversal. The sub slots may be configured to effect such lateral movement either unidirectionally to the right or to the left.

In one aspect the slot system has one or more bottom exit channels so the outer bushing is rotatable freely around the mandrel. When the bushing is on a coiled tubing string (including such a string with a downhole motor) and the spear has engaged the packer, the coiled tubing can be lowered so that the rotary shoe contacts the packer. Then the downhole motor is activated and the packer is milled. If the packer is freed, the spear holds it and the outer bushing is caught, if it falls, by the slot system engaging the keys. Alternatively such a packer mill may be used on a work string rotated by a conventional rotary from the surface.

The present invention discloses, in certain embodiments a packer mill system for removing a packer from a wellbore, the packer mill having a bushing having a hollow generally cylindrically shaped bushing body with a bottom, a top, a bushing bore extending therethrough from top to bottom, and at least one key on an interior surface thereof, the at least one key projecting inwardly into the bushing bore, a mandrel initially disposable within the bushing, the mandrel having a hollow generally cylindrically shaped mandrel body with a top, a bottom, a mandrel bore extending therethrough from top to bottom, and a slot system formed in an exterior surface of the mandrel body, the at least one key disposed for movement in and through the slot system, engagement apparatus connected to the bottom of the mandrel body for engaging the packer, milling apparatus connected to the bottom of the bushing body and disposed for movement therethrough of the engagement apparatus, and the slot system having a top and a bottom and a series of interconnected slots through which the at least one key is movable, the series of interconnected slots including exit means for movement of the at least one key out from the slot system thereby freeing the bushing from the mandrel; such a system wherein the at least one key is two spaced-apart keys; such a system wherein the exit means includes at least one top opening in the slot system for an exit of the at least one key from the top of the slot system and at least one bottom opening for an exit of the at least one key from the bottom of the slot system; such a system wherein the engagement apparatus is engageable with the packer while the bushing is disengageable from the mandrel to remove the milling apparatus from the wellbore; such a system wherein the at least one key is movable through the slot system so that the bushing is lowered below and beyond the slot system to bring the milling apparatus into contact with the packer for milling the packer while the engagement apparatus holds the packer; any such system wherein the milling apparatus is a rotary shoe; any such system wherein the engagement apparatus is a wellbore spear; any such system wherein the engagement apparatus is a wellbore overshot; any such system wherein the bushing is initially shear pinned to the mandrel with at least one shear pin and the bushing is selectively releasable from the mandrel by shearing the at least one shear pin; any such system wherein the at least one key is sized and disposed so that a packer falling with the engagement apparatus engaged thereto is stopped by the at least one key entering and being held by the slot system of the bushing as the mandrel moves down with the falling packer; any such system wherein the at least one key is so disposed and the slot system is so configured that the slot system can hold the at least one key so that an engaged packer may be jarred by moving the packer mill system; any such system wherein the slot system is configured so that the bushing is removable therefrom without applying torque to a packer engaged by the engagement apparatus; any such system wherein the bushing, having been removed from the wellbore, is re-insertable thereinto to traverse the slot system without applying torque to the packer to again mill the packer; any such system with a downhole motor interconnected with the bushing, and wherein the milling apparatus is rotated by the downhole motor; any such system is a continuous system extending around an entire outer circumference of the mandrel; any such system with a coiled tubing string extending into the wellbore, and the bushing interconnected with the coiled tubing string; any such system with the bushing and mandrel each having a fluid flow bore therethrough for the pumping of fluid down to and out from the milling apparatus to facilitate removal of milled cuttings from the wellbore; any such system with a downhole motor connected to the coiled tubing string.

The present invention, in certain aspects, discloses a slot system for a wellbore tool, the slot system having at least one intermediate slot through which a key (or keys) of an apparatus is movable, a top opening in communication with the at least one intermediate slot so that the key is movable into the top opening and from thence into the at least one intermediate slot, and a bottom opening in communication with the at lest one intermediate slot so that the key is movable from the intermediate slot into the bottom opening and from thence out from the slot system; such a system wherein the at least one intermediate slot is a series of a plurality of interconnected slots; such a system wherein the plurality of interconnected slots includes at least one slot for holding the key so that an item to which the key is connected is able to pick up a tool having the slot system; such a system wherein the plurality of interconnected slots includes at least one slot for holding the key so that an item to which the key is connected can push down on the slot system to push down on a tool having the slot system; such a slot system wherein the tool has a circumferential surface and the slot system is a continuous slot system disposed around the circumferential surface; such a slot system wherein the key is connected to a wellbore device and the key is movable through the slot system without applying torque to the device; and such a system wherein the key (or keys) is connected to a wellbore device, the key(s) movable through the slot system by moving the device up and down for longitudinal movement and with slots of the plurality of interconnected slots configured and connected to effect lateral (torsional) movement of the device.

The present invention, in certain aspects, discloses a method for retrieving a packer secured in a wellbore, the method including introducing a packer mill system into the wellbore, the packer mill system like any system described herein, releasing the mandrel from a bushing of the packer mill system, engaging the packer with engagement apparatus of the packer mill system, releasing the bushing from the mandrel, moving an at least one key of the packer mill system, through a slot system thereof, moving milling apparatus of the packer mill system into contact with the packer, rotating the bushing to rotate the milling apparatus to mill the packer, moving the bushing and the milling apparatus up away from the packer, engaging the at least one key in the slot system, and pulling up on the packer with the packer mill system to remove the packer from the wellbore; such a method including jarring the packer prior to pulling up on it; such a method with the packer engaged by the engagement apparatus, lifting the bushing and milling apparatus so the at least one key traverses through the slot system, and removing the bushing and milling apparatus from the wellbore; such a method wherein the bushing and milling apparatus are removed from the wellbore without applying torque to the packer; such a method including reintroducing the bushing and milling apparatus into the wellbore, traversing the at least one key through the slot system, and again milling the packer; such a method wherein the bushing and milling apparatus are reintroduced without applying torque to the packer; such a method including rotating the bushing with a downhole motor in a string connected to the bushing; such a method wherein the string comprises coiled tubing; such a method wherein the bushing and mandrel each have a fluid flow bore therethrough for the pumping of fluid down to and out from the milling apparatus to facilitate removal of milled cuttings from the wellbore, wherein the bushing is connected to a string extending to a surface pump, and the method includes pumping fluid through the string, to the bushing, and to and out from the milling apparatus during milling to facilitate removal of milled cuttings from the wellbore.

It is, therefore, an object of at least certain preferred embodiments of the present invention to provide:

New, useful, unique, efficient, nonobvious devices and methods for packer milling apparatus;

Such an apparatus with a mill or rotary shoe which is on a bushing that is selectively removable from a wellbore (e.g. to redress or replace the mill or shoe) while a packer to be milled remains engaged by an engagement part of the apparatus, including but not limited to, a spear;

Such an apparatus which is usable with coiled tubing and/or with a downhole motor;

Such an apparatus which is used in a single trip (or a limited number of trips) method to enter a wellbore, engage an item (e.g. a stuck packer), mill the packer, and retrieve all or part of it from the wellbore;

Such an apparatus which uses solely unidirectional torsion applied solely by a slot system; e.g. in one aspect, only right hand rotation or, in another aspect, only left hand rotation; and which, in certain aspects, does not require rotation (torque) in alternate directions, and, therefore is usable with a downhole or mud motor on coiled tubing;

Such an apparatus with such an engagement apparatus that if the packer is milled free and falls with the mandrel, key(s) on the bushing enter into and engage the slot system thereby catching the falling mandrel-spear-packer combination;

Such an apparatus wherein the outer bushing can re-engage the inner mandrel after milling to pull on a packer to facilitate freeing the packer; and Such an apparatus with which a bushing with a replaced rotary shoe may be re-inserted into a wellbore and re-united with the mandrel without applying torque to the system (other than by a slot system); and, therefore, such an apparatus which can be used with a downhole motor.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously mentioned problems and long-felt needs and provides a solution to those problems and a satisfactory meeting of those needs. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 2A, 3A, 4A, 5A, and 6A are side cross-section views of certain components of the system of FIG. 1.

FIGS. 2B, 3B, 4B, 5B, and 6B are side views showing key positions in the slot system of the system of FIG. 1.

DESCRIPTION OF EMBODIMENTS PREFERRED AT THE TIME OF FILING FOR THIS PATENT

Figure 1:
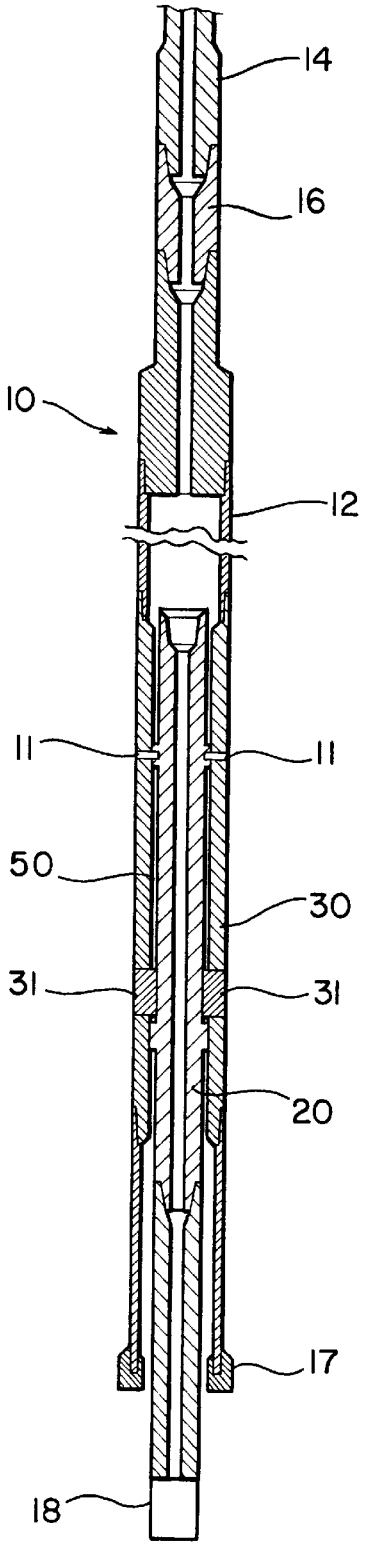
FIG. 1 is a side view, partially schematic, of a system according to the present invention.

Referring now to FIG. 1, a system 10 according to the present invention has an inner mandrel 20 shear pinned by pins 11 to an outer bushing 30. Keys 31 of the outer bushing 30 project into a slot system 50 on and extending continuously around an outer surface of the mandrel 20. An engagement apparatus, e.g. a spear 18 (shown schematically) is connected at a lower end of the mandrel 20. A top of the bushing 30 is connected to a pipe 12 (e.g. a wash pipe or a wash pipe extension,) which in turn is connected to drive sub 9, a downhole motor 16, and a coiled tubing string 14. A rotary shoe 17 is connected to a lower end of the bushing 30. The series of interconnected slots and openings (e.g. as in FIG. 2B) may be repeated as many times as need to extend around a surface's entire 360° circumference so that key entry into the system at any point will effect the desired movement(s).

Figure 2A:
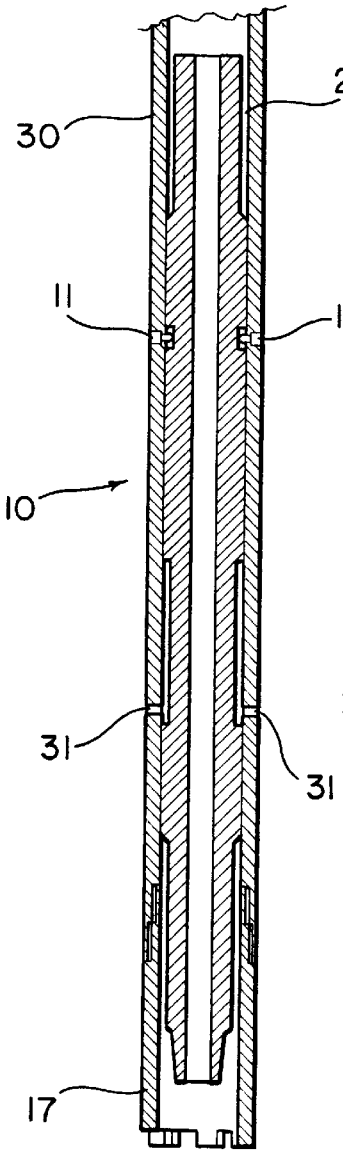
FIGS. 2A, 2B; 3A, 3B; 4A, 4B; 5A, 5B; and 6A, 6B show various positions of components of the system of FIG. 1 and various positions of keys in a slot system of the system of FIG. 1.
Figure 2B:
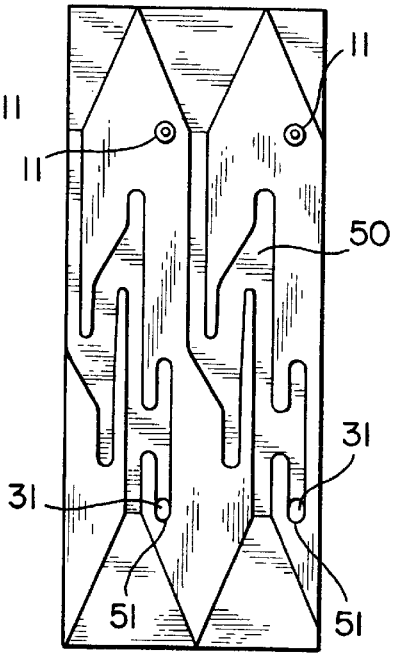

FIG. 2A shows the system 10 (partially) in a "running in hole position" with the shear pins 11 in place and not sheared and with the keys 31 in lower branches 51 of the slot system 50. Any fluid in the wellbore is flowing up into and around the mandrel 20 and the string above it as the system is lowered. The system 10 is in this configuration until the packer is contacted. Preferably the spear 18 extends out beyond the rotary shoe to engage the packer (not shown).

The spear 18 enters and then engages the packer to be removed from the wellbore. The operator "takes a strain," i.e., pulls up on the string to check packer engagement, but without shearing the shear pins 11. Then the string is pulled upwardly with sufficient force to shear the shear pins 11, freeing the bushing 30 for downward movement with respect to the mandrel 20 so the rotary shoe 17 can move to mill the packer. In one aspect the rotary shoe is dressed with a smooth outer diameter (or a rough dressing is ground smooth) and with rough dressing on its lower end and on its lower interior.

Figure 3A:
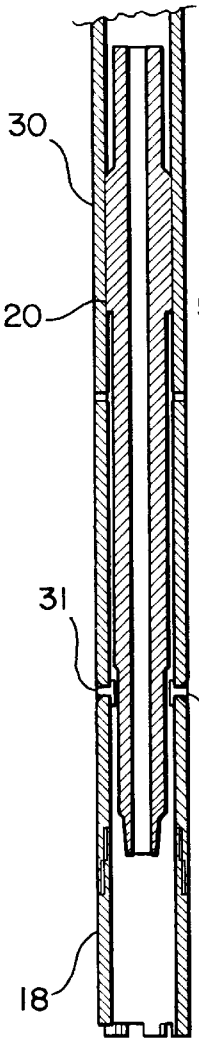
Figure 3B:
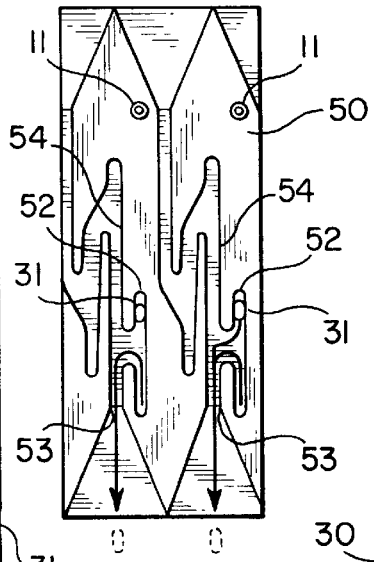

After picking up on the work string to shear the shear pins 11, the keys 31 first move into upper branches 52 of the slot system 50 as shown in FIG. 3B, and then, as indicated by the downwardly pointing arrows in FIG. 3B, as right hand rotation is applied to the work string (e.g. mechanically as with conventional rotary rigs or hydraulically with a downhole motor in the string) and hence to the bushing 30 and as the work string is lowered, the keys 31 exit the slot system 50 from exit channels 53 in communication with middle slots 54 (keys 31 upon exit shown in dotted lines in FIG. 3B). Thus the bushing 30 and the work string are freed from the mandrel 20, and the pipe 12, bushing 30 and rotary shoe 18 are free to move downward to contact the packer and free to rotate.

It is within the scope of this invention to have a single in-out slot system (half the system shown in FIG. 3B) or to have a plurality (two, three, four, five or more) of such in-out configurations, including a continuous series of them extending completely around (360° circumference) a tubular (either on an outside surface thereof or on an inside surface thereof with keys) appropriately correspondingly on an inside surface or outside surface of another member). For each in-out sub system there may be a separate key or only one or two keys may be used no matter how many in-out slot sub systems.

If, while milling of the packer, the rotary shoe (or other milling device) becomes worn and needs to be re-dressed with matrix milling material and/or inserts (any known matrix milling material, any known inserts, in any known array, pattern, or combination), the bushing 30 and rotary shoe may be removed by traversing the slot system 50 (see FIG. 5 and discussion about it, below), using single direction, e.g. right hand rotation of the working string (either mechanical or with downhole motor) so that they are freed from the mandrel 20 for removal from the wellbore. The spear 18 remains engaged in the stuck packer for re-engagement upon re-insertion of the bushing 30.

Upon completion of milling of the packer (in one aspect milling of a slip or slips that maintain the packer in position), the freed packer may fall with the spear 18 and interconnected mandrel 20. As the mandrel 20 falls, the keys 31 on the bushing 30 are directed by guide walls 55 of the channels 53 into the middle slots 54 of the slot system 50 (see upwardly pointing arrows in FIG. 4B). The keys 31 then move into and are held in upper slots 56, stopping further falling of the packer and catching the packer-spear-mandrel combination.

If the packer is loosened, but does not fall, the bushing 30 can be pulled upwardly so the keys 31 re-engage the slot system 50. Then the work string is pulled upwardly in an attempt to free the loosened packer by pulling and/or jarring it.

Once the packer is free and the bushing 30 is in engagement with the mandrel 20, pulling up on the work string 14 pulls up the bushing-mandrel-spear-packer combination for removal thereof from the wellbore.

Figure 4A:
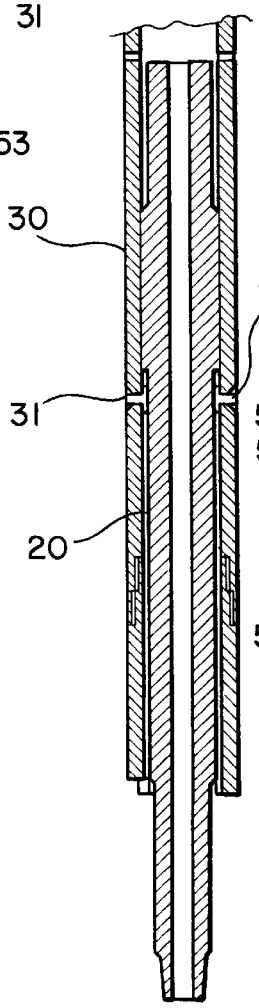
Figure 4B:
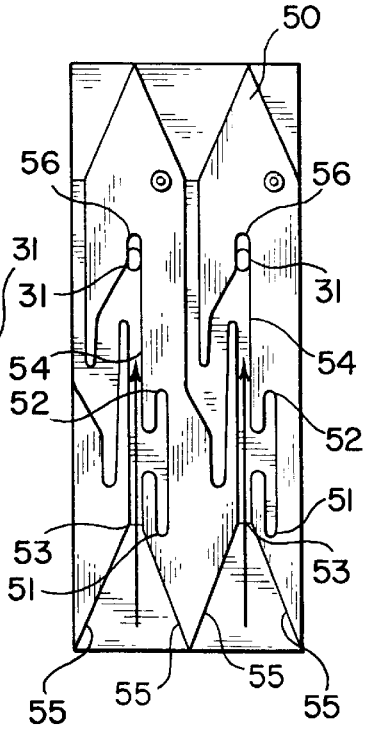
Figure 5A:
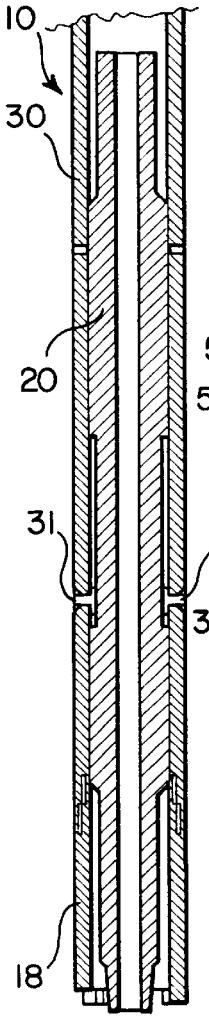
Figure 5B:
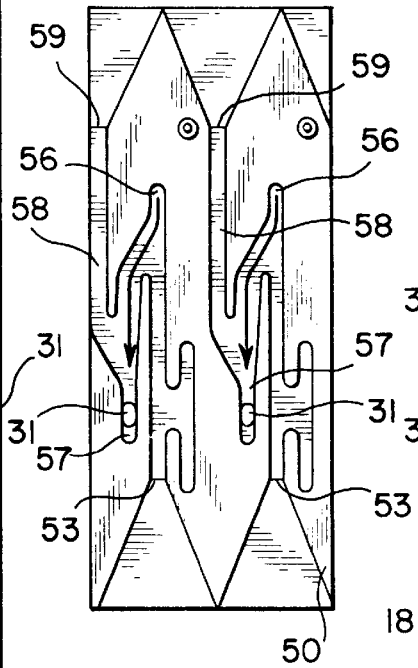
Figure 6A:
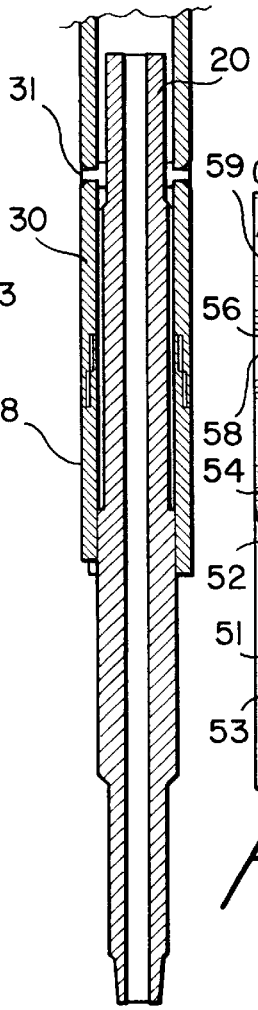
Figure 6B:
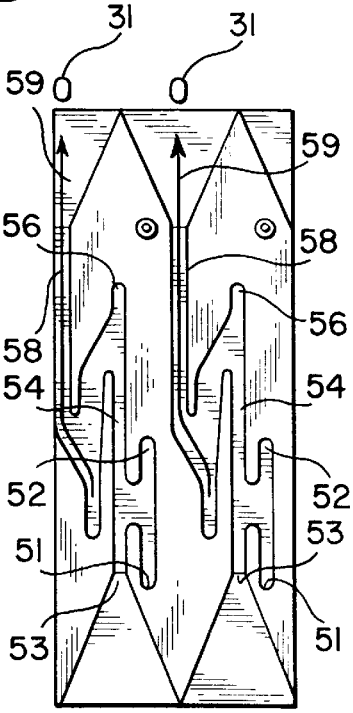

FIGS. 4 and 5 illustrate the release of the bushing 30 above the slot system 50, e.g. for removal of the bushing 30 to replace the rotary shoe 18. The keys 31 are moved from a position in the upper slots 56 by applying single direction, e.g. right hand, torque to the work string (either mechanically or with a downhole motor) while lowering it, thus moving the keys as shown by the downwardly pointing arrows in FIG. 5B into intermediate slots 57. Slacking off on the work string and sensing "down weight" indicates that the keys 31 are in the slots 57 By "down weight" is meant that when the string is lowered to place the keys in the slots 57, if the packer is still stuck, continued lowering of the string forces the packer to support some weight ("down weight") of the string and the surface weight indicator shows a reduction in string weight supported from the surface. As shown in FIG. 6B, while still holding the right hand torque, the work string is raised which moves the keys 31 into side slots 58 and from there out top exit channels 59, thus freeing the bushing 30 and rotary shoe 18 from the mandrel 20 for removal from the wellbore.

Without applying any torque, the bushing 30 and a new or redressed rotary shoe 18 can be reinstalled, traversing the slot system 50. When the keys 31, moving downwardly, contact the top exit slots 59, the slot shape moves the keys into the side slots 58 and continued downward movement coupled with the slot shape at the bottom of the slots 58 moves the keys 31 into the intermediate slots 57. Then picking up on the work string moves the keys 31 up and the slot shape moves the keys into the upper slots 56. Lowering the work string at this point moves the keys 31 downwardly with respect to the slot system 50 so that they exit through the bottom exit channels 53 so milling can commence. This may all be done without the application of torque to the work string. This is desirable in embodiments using a mud motor since left hand (or multi-directional) torque cannot be applied with a mud motor. The various slot walls are at angles so that the slot walls themselves apply leftward force on the keys to produce the desired manipulation of and movement through the slot system 50. It is to be understood that what is described above is a unidirectional system, i.e., only right hand movement or torque/rotation is used; but it is within the scope of this invention to configure the system, again unidirectionally, so that only left hand movement or torque/rotation is used (e.g. if a mud motor was used that was designed to rotate to the left) 1, 2, 3, 4, 5, or more keys 31 may be used. It is to be understood that it is within the scope of this invention to use the system 10 with a conventional work string rotated by a rotary table (in which case the rotary shoe may be installed without applying torque, but using upward/downward movement of the work string only with lateral motion effected by the slots of the slot system itself. In addition to use of the system 10 to retrieve a packer, it may be used to "fish" any device or item from a wellbore.

In one aspect the system 10 as described above and other systems according to the present invention can engage a "fish" or a packer to be removed, mill and/or loosen it, free it, and remove it in a single trip into a wellbore. In other aspects, such a removal is effected with one or more intermediate steps to remove a milling device (while the fish or packer is still engaged by an engagement tool such as a spear or overshot) to redress it or replace it.

In one method of operating a system according to the present invention, (a system using a rotary table and a typical rig set-up with a kelly and a work string made up of drill pipe), an operator, before lowering the work string, ensures that sufficient kelly is available above the rotary table to enable engagement with a fish in the wellbore while still having sufficient kelly for releasing from the system's outer bushing and milling over the fish. In the event there is premature engagement with the fish, engagement is completed and then the bushing is released. The system is then withdrawn up hole to remove a section of drill pipe. Upon final complete engagement with the fish, the bushing is released from the mandrel by pick-up on the work string with the required over-pull to shear the shear pins (e.g. shear pins 11). Then an additional over-pull (e.g. but, not limited to, a overpull) 10,000 pound is applied to assure attachment of the mandrel and bushing. While holding right hand torque, the work string is lowered so that the keys exit the slot system. At this point the bushing can be rotated. The work string is lowered further until the rotary shoe makes contact with a top of the fish. The work string is then picked up once contact is made with the fish establishing the location of the fish. Then surface pumps are started to establish fluid circulation down to and out from the rotary shoe [or other mill(s)] for cuttings, the work string is rotated to the required RPM's for milling, and weight is applied on the rotary shoe to mill over the fish. When the fish is free, the work string is pulled out of the hole with the fish.

In certain preferred embodiments sufficient spacing is available between the catching device (e.g. a spear, taper tap, etc) and the bottom of the rotary shoe so that the catching device is operable and there is sufficient clearance to rotate the shoe above the fish with the keys of the bushing below the slot system of the mandrel; the inside diameter of the rotary shoe is large enough to pass over the catching device; the inside diameter of the keys on the bushing do not bump up on the catching device; and enough spacing is below the bushing to cover the total length of the fish being milled over.

During milling with the system 10, fluid (e.g. drilling mud, or other known wellbore fluids) is pumped down the work string, through the wash pipe and through the bushing 30 to the rotary shoe (or other mill) 18 to circulate cuttings from the wellbore and to remove cuttings and debris from the shoe-packer interface.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A packer mill system for removing a packer from a wellbore, the packer mill system comprising a bushing having a hollow generally cylindrically shaped bushing body with a bottom, a top, a bushing bore extending therethrough from top to bottom, and at least one key on an interior surface thereof, the at least one key projecting inwardly into the bushing bore, the bushing rotatable in a first direction and in a second direction opposite the first direction, a mandrel initially disposable within the bushing, the mandrel having a hollow generally cylindrically shaped mandrel body with a top, a bottom, a mandrel bore extending therethrough from top to bottom, and a slot system formed in an exterior surface of the mandrel body, the at least one key disposed for movement in and through the slot system, engagement apparatus connected to the bottom of the mandrel body for engaging the packer, milling apparatus connected to the bottom of the bushing body and disposed for movement therethrough of the engagement apparatus, the slot system having a top and a bottom and a series of interconnected slots through which the at least one key is movable, the series of interconnected slots including exit means for movement of the at least one key out from the slot system thereby freeing the bushing from the mandrel, a coiled tubing string extending into the wellbore, a downhole motor interconnected between the coil tubing and the bushing for providing rotation in the first direction, and the bushing configured and positioned so that pulling upon the bushing moves the at least one key to contact the slot system thereby rotating the bushing in the second direction, wherein the milling apparatus is rotated by the downhole motor.

2. The packer mill system of claim 1 wherein the at least one key is two spaced-apart keys.

3. The packer mill system of claim 1 wherein the exit means includes at least one top opening in the slot system for an exit of the at least one key from the top of the slot system and at least one bottom opening for an exit of the at least one key from the bottom of the slot system.

4. The packer mill system of claim 3 wherein the engagement apparatus is engageable with the packer while the bushing is disengageable from the mandrel to remove the milling apparatus from the wellbore.

5. The packer mill system of claim 3 wherein the at least one key is movable through the slot system so that the bushing is lowered below and beyond the slot system to bring the milling apparatus into contact with the packer for milling the packer while the engagement apparatus holds the packer.

6. The packer mill system of claim 1 wherein the milling apparatus is a rotary shoe.

7. The packer mill system of claim 1 wherein the engagement apparatus is a wellbore spear.

8. The packer mill system of claim 1 wherein the engagement apparatus is a wellbore overshot.

9. The packer mill system of claim 1 wherein the bushing is initially shear pinned to the mandrel with at least one shear pin and the bushing is selectively releasable from the mandrel by shearing the at least one shear pin.

10. The packer mill system of claim 1 wherein the at least one key is sized and disposed so that a packer falling with the engagement apparatus engaged thereto is stopped by the at least one key entering the slot system of the bushing as the mandrel moves down with the falling packer.

11. The packer mill system of claim 1 wherein the at least one key is so disposed and the slot system is so configured that the slot system can hold the at least one key so that an engaged packer may be jarred by moving the packer mill system.

12. The packer mill system of claim 1 wherein the slot system is configured so that the bushing is removable therefrom without applying torque to a packer engaged by the engagement apparatus.

13. The packer mill system of claim 1 wherein the bushing, having been removed from the wellbore, is re-insertable thereinto to traverse the slot system without applying torque to the packer to again mill the packer.

14. The packer mill system of claim 1 wherein the slot system is a continuous system extending around an entire outer circumference of the mandrel.

15. The packer mill system of claim 1 further comprising the bushing and mandrel each having a fluid flow bore therethrough for the pumping of fluid down to and out from the milling apparatus to facilitate removal of milled cuttings from the wellbore.

16. A method for retrieving a packer secured in a wellbore, the method comprising introducing a packer mill system into the wellbore, the packer mill system comprising a bushing having a hollow generally cylindrically shaped bushing body with a bottom, a top, a bushing bore extending therethrough from top to bottom, and at least one key on an interior surface thereof, the at least one key projecting inwardly into the bushing bore, a mandrel initially disposable within the bushing, the mandrel having a hollow generally cylindrically shaped mandrel body with a top, a bottom, a mandrel bore extending therethrough from top to bottom, and a slot system formed in an exterior surface of the mandrel body, the at least one key disposed for movement in and through the slot system, engagement apparatus connected to the bottom of the mandrel body for engaging the packer, milling apparatus connected to the bottom of the bushing body and disposed for movement therethrough of the engagement apparatus, and the slot system having a top and a bottom and a series of interconnected slots through which the at least one key is movable, the series of interconnected slots including exit means for movement of the at least one key out from the slot system thereby freeing the bushing from the mandrel, the bushing selectively releasably connected to the mandrel, a coiled tubing string extending into the wellbore, a downhole motor interconnected between the coil tubing and the bushing for providing rotation in the first direction, the bushing configured and positioned so that pulling up on the bushing moves the at least one key to contact the slot system thereby rotating the bushing in the second direction, and wherein the milling apparatus is rotated by the downhole motor, releasing the mandrel from the bushing, engaging the packer with the engagement apparatus, releasing the bushing from the mandrel, moving the at least one key through the slot system, moving the milling apparatus into contact with the packer, rotating the bushing with the downhole motor to rotate the milling apparatus in the first direction to mill the packer, moving the bushing and the milling apparatus up away from the packer, engaging the at least one key in the slot system thereby providing rotation of the bushing in the second direction, and pulling up on the packer with the packer mill system to remove the packer from the wellbore.

17. The method of claim 16 further comprising jarring the packer prior to pulling up on it.

18. The method of claim 16 further comprising prior to retrieving the packer and with the packer engaged by the engagement apparatus, lifting the bushing and milling apparatus so the at least one key traverses through the slot system, and removing the bushing and milling apparatus from the wellbore.

19. The method of claim 18 wherein the bushing and milling apparatus are removed from the wellbore without applying torque to the packer.

20. The method of claim 18 further comprising reintroducing the bushing and milling apparatus into the wellbore, traversing the at least one key through the slot system, and again milling the packer.

21. The method of claim 20 wherein the bushing and milling apparatus are reintroduced without applying torque to the packer.

22. The method of claim 16 wherein the bushing and mandrel each having a fluid flow bore therethrough for the pumping of fluid down to and out from the milling apparatus to facilitate removal of milled cuttings from the wellbore, wherein the bushing is connected to a string extending to a surface pump, and the method further comprising pumping fluid through the string, to the bushing, and to and out from the milling apparatus during milling to facilitate removal of milled cuttings from the wellbore.

* * * * *